US008251260B2

(12) United States Patent
Hung

(10) Patent No.: US 8,251,260 B2
(45) Date of Patent: Aug. 28, 2012

(54) CAULKING GUN

(75) Inventor: Hung-Chih Hung, Hemei Township, Changhua County (TW)

(73) Assignee: Siang Syuan Fu Industry Co., Ltd., Changhua County (TW)

( * ) Notice: Subject to any disclaimer, the term of this patent is extended or adjusted under 35 U.S.C. 154(b) by 360 days.

(21) Appl. No.: 12/728,279

(22) Filed: Mar. 22, 2010

(65) Prior Publication Data

US 2011/0155769 A1 Jun. 30, 2011

(30) Foreign Application Priority Data

Dec. 29, 2009 (TW) ..... 98145412 A

(51) Int. Cl.
*B05C 17/01* (2006.01)

(52) U.S. Cl. ..... 222/392; 222/326; 222/391

(58) Field of Classification Search ..... 222/326, 222/391, 392; *B05C 17/01*
See application file for complete search history.

(56) References Cited

U.S. PATENT DOCUMENTS 2,118,154 A * 5/1938 Buedingen ..... 222/44
2,240,046 A * 4/1941 Marra ..... 222/391
3,229,865 A * 1/1966 Heisler et al. ..... 222/391
3,894,663 A * 7/1975 Carhart et al. ..... 222/309
4,318,499 A * 3/1982 Hamilton ..... 222/327
5,637,095 A * 6/1997 Nason et al. ..... 604/135
6,824,018 B1 * 11/2004 Eaddy et al. ..... 222/153.13

FOREIGN PATENT DOCUMENTS

JP 2000033305 A * 2/2000
JP 2001317214 A * 11/2001
JP 2002327528 A * 11/2002

* cited by examiner

*Primary Examiner* — Kevin P Shaver
*Assistant Examiner* — Daniel R Shearer
(74) *Attorney, Agent, or Firm* — Leong C. Lei

(57) ABSTRACT

A caulking gun includes a housing forming a handle and supporting a cartridge holder for receiving and holding a caulking cartridge. A flexible push plate is received through the housing to have a front end extending into the cartridge holder to carry a push disk. The housing has front and rear portions respectively receiving therein an advancer and a gripper through which the push plate extends. A guide roller is rotatably received in the housing rearward of the gripper. A rear end of the push plate extends through the gripper and is wrapped around the guide roller for further extension frontward to project outside and above the cartridge holder. When a trigger of the handle comprising a trigger is actuated to cause the advancer to advance the push plate frontward for extrusion of the caulking cartridge to dispense caulking, the gripper holds and prevents the push plate from returning rearward.

3 Claims, 6 Drawing Sheets

CAULKING GUN

TECHNICAL FIELD OF THE INVENTION

The present invention generally relates to a caulking gun having a structure that allows for substantial reduction of the overall size thereof, flexible operation, and easy carrying, storage, and use.

DESCRIPTION OF THE PRIOR ART

Taiwan Utility Model No. M311486, which was issued on May 11, 2007, discloses a push buffering structure of a caulking gun. The structure of the Taiwan Utility Model is described in Claim 1 thereof, which is quoted as follows:

A push buffering structure of a caulking gun, comprising a carriage section, a pushing section, a buffering section, and a depressing section; the carrier section forming a front support frame into which a caulk cartridge can be loaded, the pushing section comprising a rear support frame mounted to one side of the front support frame, the rear support frame of the pushing section receiving therein a push plate and a spring, the buffering section being formed on one side of the rear support frame of the pushing section, a push bar extending in sequence through the buffering section, the rear support frame of the pushing section, the push plate of the pushing section, the spring of the pushing section, and the front support frame of the carriage section, the push bar having an end extending into the front support frame of the carriage section and carrying a push disk, the buffering section forming a handle and a depression grip, the handle being formed below the rear support frame of the pushing section, the depression grip having an upper portion with two pins extending therethrough, one pin of the depression grip being pivotally mounted to the rear support frame of the pushing section, another pin of the depression grip extending through and received in an operation space defined in the rear support frame of the pushing section, the upper portion of the depression grip comprising two portions located on opposite sides of the pins and set in engagement with a lower end of the push plate of the pushing section and the rear support frame of the pushing section, characterized in that the buffering section comprises a limiting member, a washer, and a spring, the limiting member forming a buffering space, the limiting member forming a hooking portion at one end of the buffering space and a receiving-through portion at an opposite end, the hooking portion of the limiting member hooking the rear support frame of the pushing section, the washer and the spring being received in the receiving space of the limiting space with an end of the push bar of the pushing section sequentially extending through the washer, the spring, and the receiving-through portion of the limiting member, the washer being biased by the spring to have one side of the washer positioned against the rear support frame of the pushing section, an opposite end of the spring being positioned against the receiving-through portion of the limiting member, and the depressing section comprising a spring, a further pin extending through and held by the depression grip of the depressing section for rotatably supporting the spring, the spring having an end positioned against the depression grip of the depressing section and an opposite end positioned against the handle of the depressing section.

According to the conventional caulking gun so constructed as discussed above, as shown in FIG. 2 of the Taiwan Utility Model, the push bar 22 that is coupled to the push disk 221 has a J-shaped rear end section extending quite a distance beyond the rear end of the depressing section 40 thereby occupying quite an amount of space. Especially at the time when the caulking cartridge is to be replaced, the push bar is completely withdrawn rearward of the depressing section 40, making the gun occupying a space of about the total length of two caulking cartridges. This takes quite an amount of space and thus makes the operation of the caulking gun very inconvenient in a limited space, or even impossible to operate the gun. This is a drawback of the conventional caulking gun.

Further, the conventional caulking gun that occupies a large amount of space is inconvenient for carrying by a user and also causes certain problems for storage and carrying. This is another drawback of the conventional caulking gun.

Thus, it is desired to have a caulking gun that overcomes the above discussed problems of the conventional caulking gun.

SUMMARY OF THE INVENTION

The primary objective of the present invention is to provide a caulking gun, which effectively prevents the caulking gun from occupying a great amount of space so as to allow the caulking gun to be easily operated in a limited space with enhanced operation flexibility.

Another objective of the present invention is to provide a caulking gun that substantially reduces the amount of space occupied thereby so as to allow for easy storage, carrying, and use.

To achieve the above objectives, the present invention provides a caulking gun having a housing composed of two semi-cylindrical shell members that mate each other to form a cylindrical housing. Extending frontward from undersides of the housing shell members is a support portion from which a handle extends downwards. A front end of the housing is coupled to a cartridge holder for receiving and holding a caulking cartridge. Respectively received and retained in front, middle and rear portions of the housing are front, central, and rear guide plates, each forming an arc-shaped guide opening to receive a push plate extending therethrough. Rotatably set rearward of the rear guide plate between the housing shell members is a guide roller around which a rear portion of the push plate is wrapped and bent to extend frontward to project out of the housing at a top side thereof. An extrusion device includes the push plate that is of a concave cross-section sequentially received through the front, central and rear guide plates. Arranged approximately between the central and rear guide plate are an upper clamp board and a lower clamp board, which closely interpose the push plate therebetween for extension through the arc-shaped guide opening of the central guide plate and also extension through an opening defined in an upper portion of an advancer arranged frontward of the central guide plate so that the push plate is wrapped around the guide roller that is set in the rear portion of the housing in a curved form and further extends in a frontward direction out of the housing above the cartridge holder to couple to a pull slide that has a bottom forming two guide slots that are slidably fit to two track plates formed on the top of the cartridge holder. A trigger has an upper portion rotatably coupled inside an upper portion of the handle and comprises a pin that forms a pivotal connection with a front end of a drive plate that is received inside the handle and below the central and rear guide plates with an inward rear end of the drive plate being located in engagement with a lower end of the gripper. The rear portion of the drive plate forms an opening into which a lower end of the advancer is inserted to form driving engagement therebetween.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
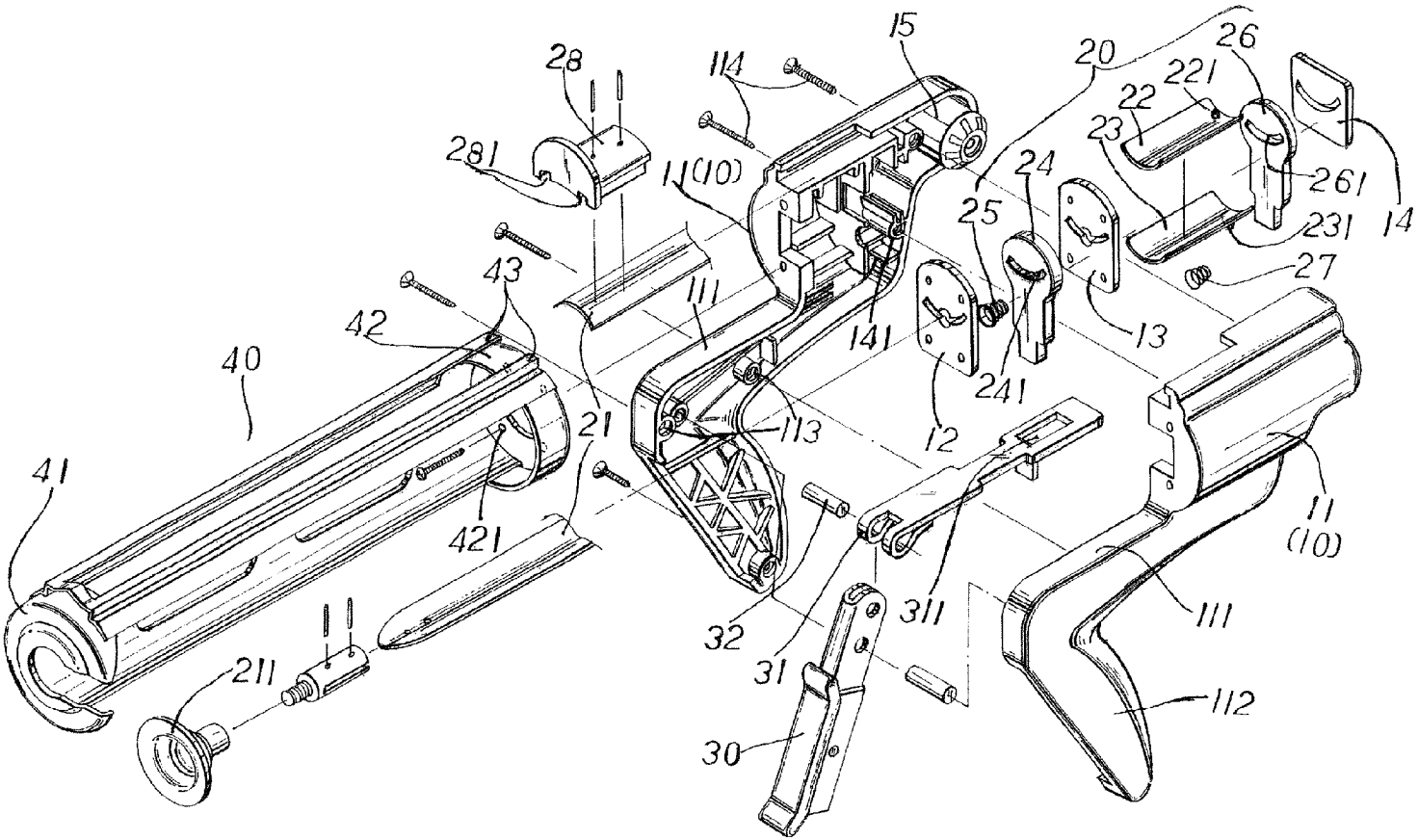
FIG. 1 is an exploded view of a caulking gun according to the present invention.

Referring to FIG. 1, the present invention provides a caulking gun, which comprises a housing 10, inside which an extrusion device 20 is mounted, a trigger 30, and a cartridge holder 40 mounted to a front end thereof.

The housing 10 is composed of two opposite housing shell members 11, which are of substantially semi-cylindrical configurations to be mated to each other to form a cylindrical housing. Extending frontward from undersides of the two semi-cylindrical housing shell members 11 is a support portion 111 from which a handle 112 extends downwards. Received and retained respectively at front, middle, and rear portions inside the housing shell members 11 are a front guide plate 12, a central guide plate 13, and a rear guide plate 14. Each of the guide plates 12, 13, 14 forms an arc-shaped guide opening to receive a push plate 21 of the extrusion device 20 to extend therethrough. Rotatably set rearward of the rear guide plate 14 between the housing shell members 11 is a guide roller 15 that guides the movement of the push plate 21. The two housing shell members 11 form projecting posts 113 that are opposite to each other and defines through holes to receive bolts 114 that secure the two housing shell members 11 together after they mate each other.

The extrusion device 20 comprises the push plate 21, which is an elongate flexible member having a concave cross-section received sequentially through the front guide plate 12, the central guide plate 13, and the rear guide plate 14 to have a front end thereof coupled to a push disk 211. Arranged approximately between the central guide plate 13 and the rear guide plate 14 are an upper clamp board 22 and a lower clamp board 23, which are of substantially the same curved concave cross-section as that of the push plate 21 to neatly interpose the push plate 21 therebetween for extension through the arc-shaped guide opening of the central guide plate 13 and also extension through a similar arc-shaped opening 241 defined in an upper portion of an advancer 24 arranged frontward of the central guide plate 13. Return stops 221, 231 are respectively formed on an upper surface of the upper clamp board 22 and a lower surface of the lower clamp board 23. Arranged rearward of the front guide plate 12 is a return spring 25 that biases the advancer 24 rearwards. The push plate 21 also extends through an arc-shaped opening 261 defined in an upper portion of a gripper 26 located between the central guide plate 13 and the rear guide plate 14. The gripper 26 has a lower portion that is positioned against a retention seat 141 that is located below and holds a lower end of the rear guide plate 14. Arranged rearward of the central guide plate 13 is a spring 27, which biases the upper portion of the gripper 26 rearwards to form an inclined configuration, whereby the arc-shaped opening 261 of the gripper 26 is set at an inclined angle that tightly engages and thus prevents the push plate 21 that is being pushed frontward from returning rearward. The push plate 21, which is flexible, has a rear portion wrapped around the guide roller 15 that is set in the rear portion of the housing 10 in a curved form and further extend in a frontward direction out of the housing 10 above the cartridge holder 40 to couple to a pull slide 28 that has a bottom forming two guide slots 281.

The trigger 30 has an upper portion rotatably coupled inside an upper portion of the handle 112 and comprises a pin 32 that forms a pivotal connection with a front end of a drive plate 31 that is received inside the handle 112 and below the support portion 111, whereby an inward rear end of the drive plate 31 is located in engagement with a lower end of the gripper 26. The rear portion of the drive plate 31 forms an opening 311 into which a lower end of the advancer 24 is inserted to form driving engagement therebetween.

The cartridge holder 40 comprises a holder body that is composed of a cylindrical wall section having a front end to which a C-shaped front frame 41 is mounted and a rear end to which a circular frame 42 that defines coupling holes 421 for coupling a front end wall of the housing 10 is mounted. Two track plates 43 are mounted to a top side of the cylindrical wall section.

Figure 3:
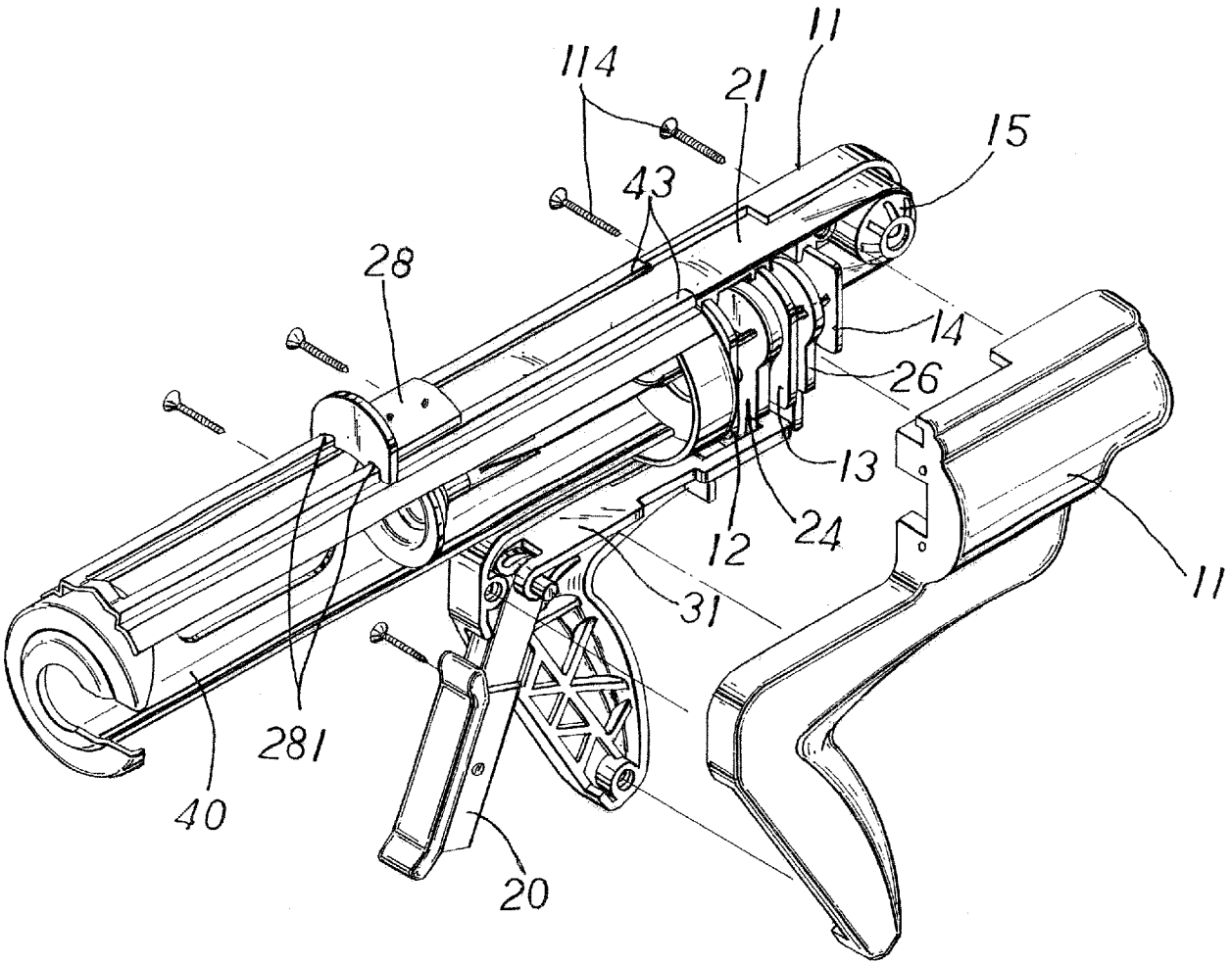
FIG. 3 is a perspective view showing the caulking gun of the present invention in a partially assembled condition.
Figure 4:
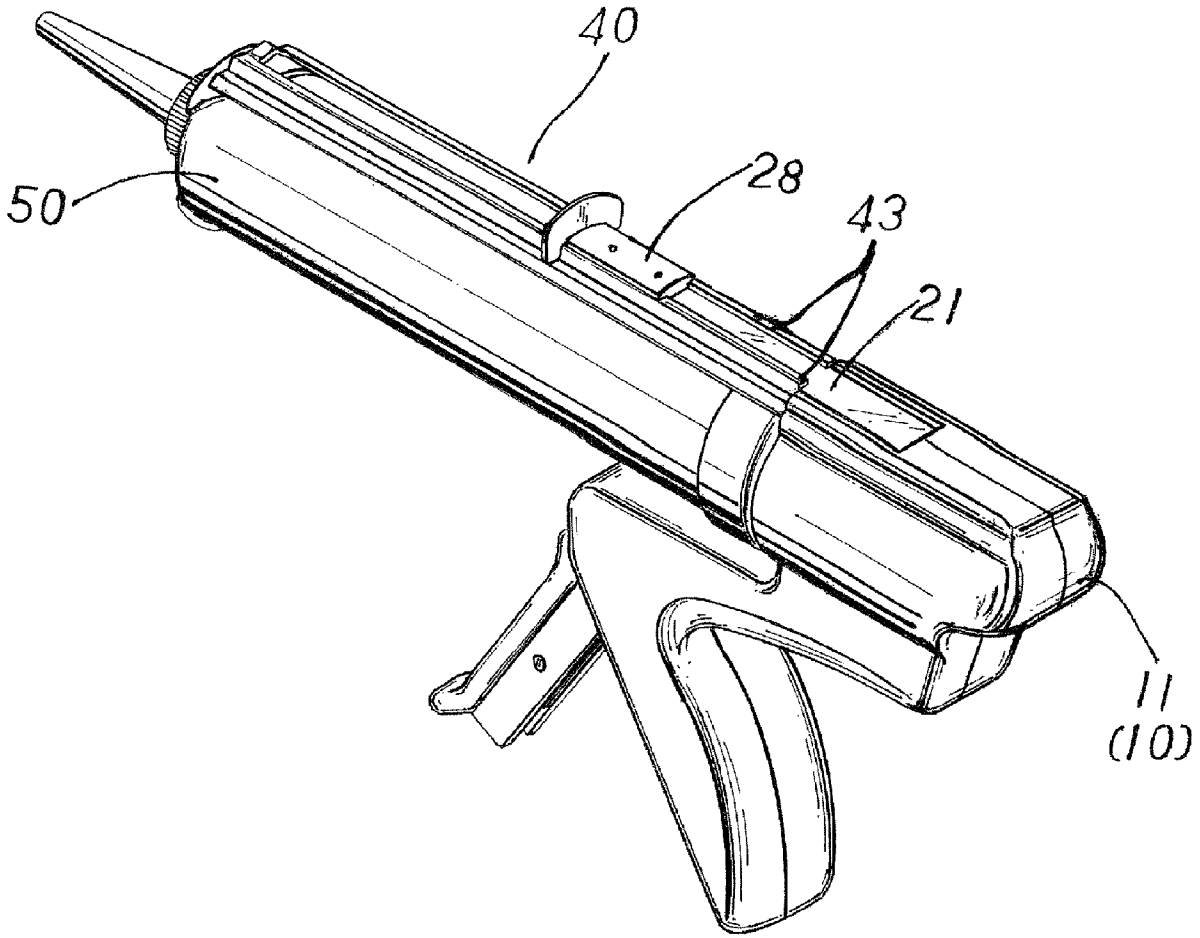
FIG. 4 is a perspective view showing the caulking gun of the present invention in a completely assembled condition.

As shown in FIG. 3, with the above structure assembled, the end of the push plate 21 extends outside and above the cartridge holder 40 to couple to the pull slide 28 and the two the guide slots 281 formed in the bottom of the pull slide 28 slidably fit to the two track plates 43 on the top of the cartridge holder 40. Afterwards, the two housing shell members 11 are put to mate each other and secured together by the bolts 114 to complete the assembling of the caulking gun as shown in FIG. 4, which can receive a caulking cartridge 50 loaded into the cartridge holder for selective and subsequent squeezing and extrusion for dispensing of caulking.

Figure 5:
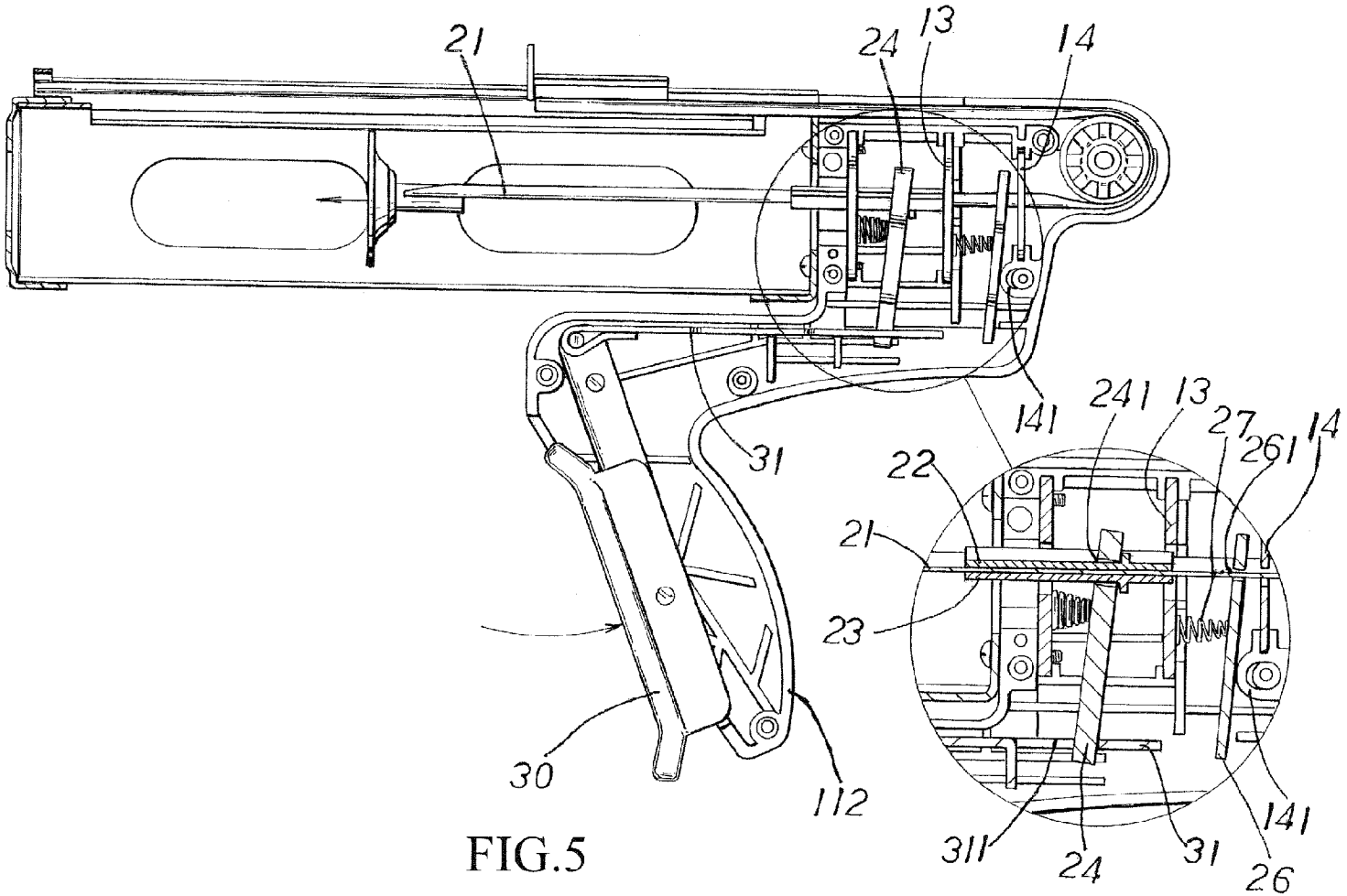
FIG. 5 is a cross-sectional view showing caulk extrusion operation of the caulking gun of the present invention.

FIG. 5 illustrates an operation of caulking extrusion according to the present invention. The trigger 30 that is pivotally connected to the handle 112 is first depressed in the direction indicated by arrow of the drawing to cause a frontward displacement of the drive plate 31 and opening 311 that is defined in the rear portion of the drive plate 31 drives the advancer 24 that is in engagement with the opening 311 frontward to an inclined condition. As shown in the detail enlarged view, the inclined arc-shaped opening 241 defined in the upper portion of the advancer 24 uses top and bottom sides thereof to tightly engage and hold, respectively from the upper side and lower side, the upper clamp board 22 and the lower clamp board 23 for securely clamping the push plate 21 therebetween for frontward push as indicated by arrow in the drawing. Meanwhile, the spring 27 located between the central guide plate 13 and the rear guide plate 14 applies a spring force to push the gripper at a location above the retention seat 141 so as to make the upper portion of the gripper 26 inclined rearward, whereby the arc-shape opening 261 of the gripper 26, due to the inclined angle thereof, tightly hold against the push plate 21 extending therethrough to prevent the push plate 21 from returning rearward.

Figure 2:
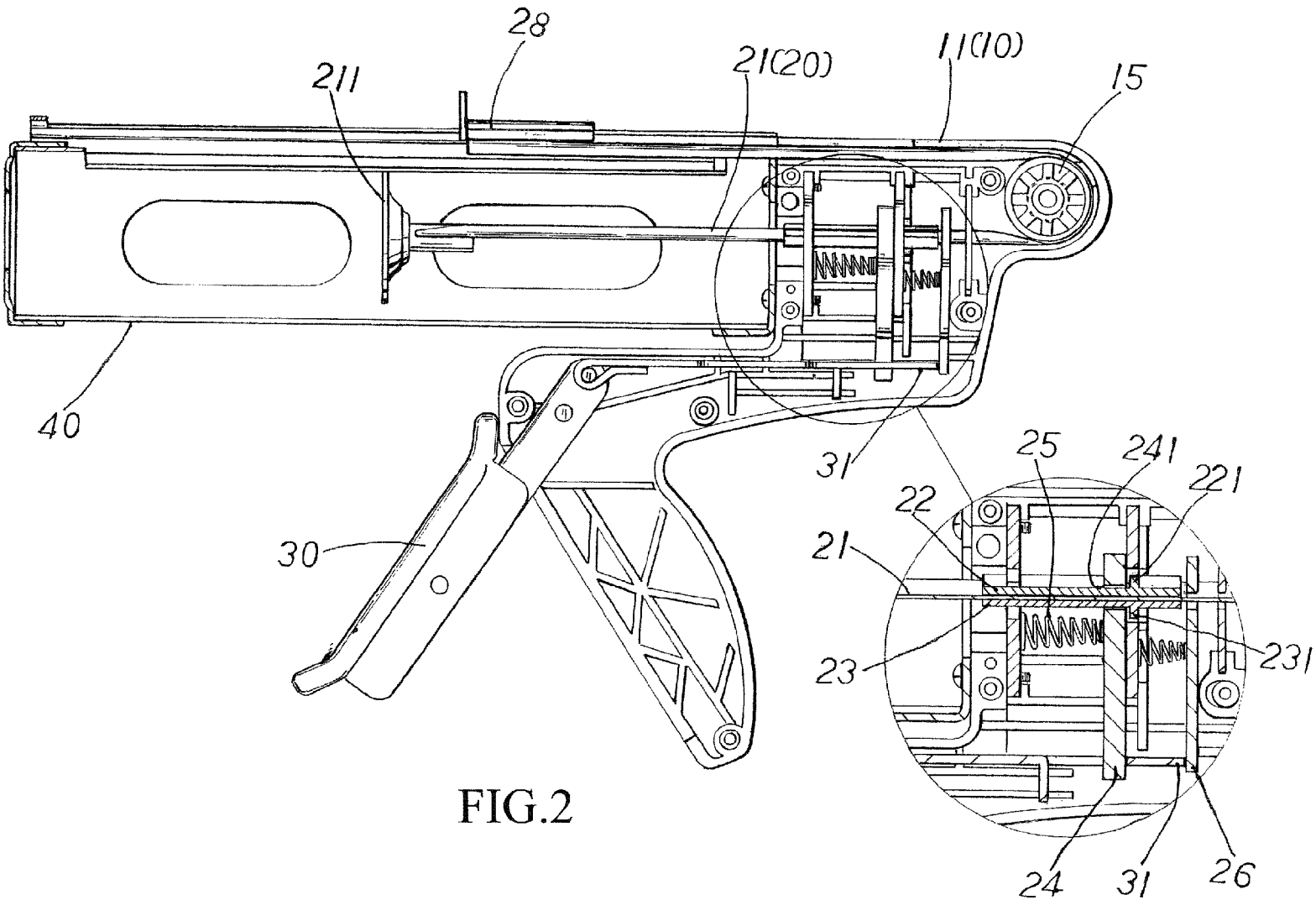
FIG. 2 is a cross-sectional view showing an assembled arrangement of internal components of the caulking gun of the present invention in a trigger released condition.
Figure 6:
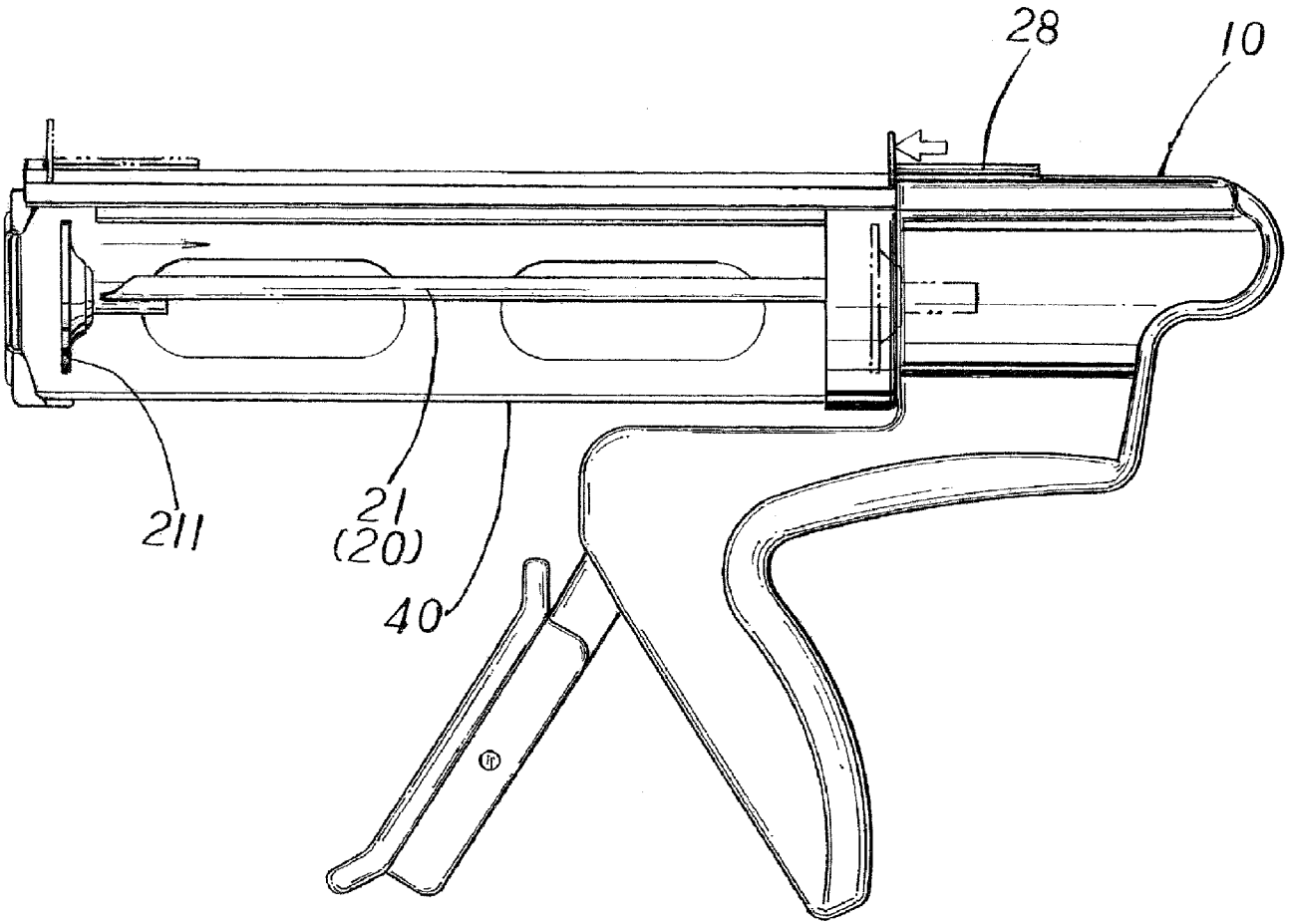
FIG. 6 is a side elevational view showing backward pulling and releasing a drive plate of the caulking gun of the present invention.

As shown in FIG. 2, after the extrusion operation, the trigger 30 is released and the return spring 25 biases the advancer 24 rearward and the top and bottom sides of the arc-shaped opening 241 are put in engagement with the return stop 221, 231 to thereby move the upper clamp board 22 and the lower clamp board 23 rearward. Under this condition, the trigger 30 can be actuated against for extrusion and dispensing of caulking. When the push disk 211 coupled to the front end of the push plate 21 is moved to the frontmost position, the trigger 30 is pulled outward to cause the drive plate 31 to move rearward, making the rear end thereof driving and setting the lower end of the gripper 26, which is previously in an inclined condition, to resume a substantially vertical condition so as to allow the arc-shaped opening 261 defined in the upper portion of the gripper 26 to release the push plate 21, by which the pull slide 28 is allowed to pull the push plate 21 rearward, as shown in FIG. 6.

As shown in FIG. 2, the curved concave cross-section of the push plate 21 allows the push plate 21 to be tightly clamped between the upper clamp board 22 and the lower clamp board 23 for advancing of the push plate 21, whereby a sufficient force can be applied to extrude frontward the caulking, and also allows the push plate 21 to be bent to wrap around the guide roller 15 located in the rear portion of the housing 10 to extend to a location above the housing 10 and the cartridge holder 40, whereby excessive occupation of space rearward of the housing 10 can be avoided, allowing flexible operation in a limited space and enhancing storage and carrying to thus provide multiple effects.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A caulking gun, comprising a housing, which comprises a handle extending therefrom and has a front end to which a cartridge holder that is adapted to receive and hold a caulking cartridge therein, an extrusion device comprising a push plate received through the housing, the push plate having a front end extending into the cartridge holder and carrying a push disk, the housing having front and rear portions respectively receiving therein an advancer and a gripper through which the push plate extends, the handle comprising a trigger, which is selectively actuated to cause the advancer to advance the push plate frontward for extrusion of the caulking cartridge to dispense caulking, where the gripper holds and prevents the push plate from returning rearward, and wherein when the gripper is released, the push plate is freed to be moved rearward, characterized in that the push plate comprises a flexible member and a guide roller is rotatably mounted in the housing and rearward of the gripper, wherein the flexible member of the push plate has a rear portion extending through the gripper and wrapped around the guide roller to be bent for further extension frontward to project outside and above the cartridge holder, whereby an outer end of the bent push plate that is located outside the caulking cartridge can be pulled to return the push plate so as to eliminate an excessive space rearward of the housing occupied by the push plate;

wherein:

the housing is composed of two opposite housing shell members, which are of substantially semi-cylindrical configurations to be mated to each other to form a cylindrical housing, a support portion extending frontward from undersides of the two semi-cylindrical housing shell members and a handle extending downwards from the support portion, a front guide plate, a central guide plate, and a rear guide plate being respectively received and retained respectively at front, middle, and rear portions inside the housing, each of the guide plates forming an arc-shaped guide opening to receive the push plate of the extrusion device to extend therethrough, the guide roller being rotatably set rearward of the rear guide plate between the housing shell members to allow the push plate to wrap therearound for extending out of the housing;

the extrusion device comprises the push plate, which is an elongate flexible member having a concave cross-section received sequentially through the front guide plate, the central guide plate, and the rear guide plate with an upper clamp board and a lower clamp board interposing the push plate therebetween and arranged approximately between the central guide plate and the rear guide plate for extension through the arc-shaped guide opening of the central guide plate and also extension through an opening defined in an upper portion of the advancer arranged frontward of the central guide plate, the push plate being wrapped around the guide roller that is set in the rear portion of the housing in a curved form to extend the housing above the cartridge holder to couple to a pull slide , the push plate being driven by the trigger pivoted to the handle to realize frontward extrusion;

the trigger has an upper portion rotatably coupled inside an upper portion of the handle and comprises a pin that forms a pivotal connection with a front end of a drive plate that is received inside the handle and below the front guide plate and the central guide plate, an inward rear end of the drive plate being located in engagement with a lower end of the gripper, the rear portion of the drive plate forming an opening into which a lower end of the advancer is inserted to form driving engagement therebetween; and the cartridge holder comprises a holder body that is composed of a cylindrical wall section having a front end to which a C-shaped front frame is mounted and a rear end to which a circular frame that defines coupling holes for coupling a front end wall of the housing is mounted, two track plates being mounted to a top side of the cylindrical wall section;

whereby when the trigger of the handle is depressed to drive the push plate for extrusion the caulking cartridge to dispense caulking, the gripper prevents the push plate from being moved rearward and when the trigger is returned, the gripper is pushed rearward to release the push plate and thus allowing the pull slide to move the push plate rearward.

2. The caulking gun according to claim 1, wherein the upper clamp board and the lower clamp board have a curved concave cross-sectional shape substantially similar to the cross-sectional of the push plate for neatly interposing and thus clamping the push plate for extension through the opening defined in the upper portion of the advancer having a similar arc-shape, an upper surface of the upper clamp board and a lower surface of the lower clamp board being respectively raised to each form a return stop, a return spring being arranged rearward of the front guide plate to bias rearward the advancer, whereby when the trigger moves the drive plate frontward at the lower end of the advancer, the arc-shaped opening formed in the upper portion of the advancer is inclined to depress the upper clamp board and the lower clamp board to tightly clamp and drive the push plate frontward and wherein when the trigger is released, the return spring biases the advancer rearward and simultaneously causes the upper clamp board and the lower clamp board to move the drive plate rearward for returning.

3. The caulking gun according to claim 2, wherein the gripper through which the push plate extends is located between the central guide plate and the rear guide plate and is positioned against a retention seat below the rear guide plate, and wherein a spring is arranged rearward of the central guide plate to bias and incline an upper portion of the gripper so that the arc-shape opening of the gripper is set in an inclined angle to have the opening tightly holding the push plate to prevent the push plate from returning rearward.

* * * * *